United States Patent [19]

Stansbury

[11] 4,167,003

[45] Sep. 4, 1979

[54] OPERATION AND COMMAND FAILURE MONITOR

[76] Inventor: Benny W. Stansbury, 115 Jason, West Monroe, La. 71291

[21] Appl. No.: 840,828

[22] Filed: Oct. 11, 1977

[51] Int. Cl.[2] ..... G08B 19/00

[52] U.S. Cl. ..... 340/501; 340/517

[58] Field of Search ..... 340/500, 501, 517, 521, 340/523, 635, 648, 52 R, 52 F, 53

[56] References Cited

U.S. PATENT DOCUMENTS

| | | | |
|---|---|---|---|
| 3,665,399 | 5/1972 | Zehr et al. | 340/501 |
| 3,949,356 | 4/1976 | Fuzzell et al. | 340/52 F |

*Primary Examiner*—Alvin H. Waring

*Attorney, Agent, or Firm*—Norvell E. Von Behren

[57] ABSTRACT

A device for monitoring equipment failures within a process plant. The device determines the following condition of a two-state contact (1) Normal; (2) Off-normal due to an abnormal condition; and (3) Off-normal due to a normal condition and functions to alert a plant operator or automatically initiate a corrective action whenever a device, piece of equipment or an electrical motor has abnormally stopped or failed to complete a commanded operation without being operator initiated or initiated by some other normal function.

In the preferred embodiment the device comprises an alarm module of the type having a memory circuit connected to a logic circuit which is connected in parallel to at least two alarm circuits. The alarm circuits comprise a flasher circuit and a time delay circuit with a third output of the device comprising a driver circuit. The flasher circuit is designed to transmit a pulsating output signal alternating between a high and a low state. The time delay circuit is designed to transmit a time delayed steady output signal. The driver circuit is designed to transmit a steady output signal which is a repeat or complement of one of the input signals.

21 Claims, 16 Drawing Figures

PROIR ART

PROIR ART

OPERATION AND COMMAND FAILURE MONITOR

BACKGROUND OF THE INVENTION

This invention is primarily related to process plant control systems and specifically relates to a new and novel monitor for determining at least three different conditions in the circuit of various types of electrical equipment.

In general, annunciators are used for process alarms of the type wherein industrial miniature oiltight pushbuttons and switches are used to start and to stop equipment with various light arrangements being used to indicate the run status of the equipment being controlled. In modern process plants most equipment is run by a large number of electric motors, whose operation is very critical to safe and continuous operation of a process plant.

Commonly the monitoring of motor failures has been implemented in one of three methods. By referring to FIGS. 1–3 of the drawing there is shown three typical monitoring methods of monitoring a simple process having a surge tank 10, one agitator 12, and two pumps comprising one active pump 14 and a spare pump 16. The agitators 12 are driven by electric motors 18, and the pumps 14 and 16 are also driven by separate motors which are not shown in the drawing. Each motor has an associated run light located on the control panel for the process equipment. In the example shown in FIGS. 1–3, the run light for the active pumps 14 would be L1-A, while the run light for the spare pumps would be L1-B. In a similar manner, the agitators 12 would have a run light L1-C. The tanks 10 have a continuous incoming product flow through the pipes 20 which is being pumped out through the pipes 22. A level indicator LI-1 is provided as well as a high/low level alarm LAHL-1 which is mounted in the control room.

The following discussion is related to FIGS. 1–3 for simplicity and ease of understanding the merits of the invention, but the basic invention is not to be limited in scope to only the illustrated process and could, for example, be used on many other processes such as a distillation column having as many as six or more pumps.

Commonly motor failures in process plants of the type illustrated in FIGS. 1–3 have been implemented in one of the following three known methods:

1. NO FAILURE ALARM (FIG. 1):

In this example the motors 18 as well as the motors for the pumps 14 and 16 are not connected to any alarm system. An operator is not immediately alerted to any particular motor failure, but will realize a failure by the consequential results in the process some time later if he is alert. In the example, should the motor for the active pump 14 fail, the level in the tank 10 will begin to rise, and there will be a loss of product downstream in the pipe 22 causing a secondary upset in the process. The operator will probably be alerted by the secondary upset caused by loss of product flow downstream or by a high tank level (LAHL-1) when the tank 10 has filled up. If the operator had been alerted to an immediate failure of the active pump 14, he could have switched to the spare pump 16 preventing the secondary upset. Should the agitator 12 fail, a secondary result may be a plugged active pump 14, plugged piping, and poor product downstream in the pipe 22. In either case, the operator is not alerted to the primary failure at the time, but only to the consequential results later. This could result in loss of product, off-grade product, hazardous situation, or a complete plant shut-down due to the failure of one motor.

2. COMMON MOTOR FAILURE ALARM (FIG. 2):

In this example auxiliary contacts from a random number or specific groups of motor starters for the active pumps 14, spare pumps 16, and agitator 12 are connected together to a common annunciator UAL-2 input. Any motor within the group that is stopped normally or fails will cause an alarm. When a failure has occurred in this manner, the operator must scan the control panel to determine from the motor lights on the panel or other secondary indications which motor within the group has failed. The annunciator window on the panel would be continuously illuminated due to the spare pumps in the system. This method of connection saves cost and panel space, but does not direct the operator to the particular problem. On the average, approximately 60% of the motors will be running during normal plant operation resulting in much time being lost in determining which motor in the process has failed.

3. ALARM EACH MOTOR (FIG. 3):

In this example a set of motor starter auxiliary contacts are connected into an individual annunciator input XAL-4 on the spare pump 16; XAL-5 on the active pump 14; and XAL-3 on the agitator motor 18. The annunciator on the panel indicates only that a motor has stopped and does not distinguish between a motor that has failed and one that has been normally stopped by the operator or by the process control. This arrangement has the following disadvantages:

A. One motor utilizes one annunciator window on the panel, increasing annunciator size and panel size, and wasting valuable and expensive face of panel space.

B. Most process pumped systems utilize two pumps (one active and one spare). Therefore, spare pumps and other motors normally not in use would have an illuminated annunciator window on the panel. An illuminated annunciator window on the panel in the general context implies there is a problem that has been operator-acknowledged, but not corrected. This is not the case for spare pumps.

C. The operator gets an alarm when a motor is stopped intentionally by the operator or by the process control.

D. A lengthy and expensive cable is required from the motor control center to the control room for each motor to be alarmed.

E. The visual display is in the annunciator window matrix on the panel which is physically remote from the motor control pushbuttons and indicator lights.

The previous discussion describes motor failure alarms in plants utilizing conventional switches, pushbuttons, and lights for operator interface and the conventional hard-wired control schemes for controlling the motor. FIGS. 4–6 indicate schematically the three most common motor control schemes employed in prior art process control. The primary difference in the three schemes is in the status indication lights L1, L2, and L3. The status lights L1, L2, and L3 may be a separate unit or included in the pushbutton or switch assembly 36 or 38. The contacts for stop 38 and start 36 may be individual pushbuttons, individual switches, or a single unit switch to perform both functions. Some users alter the arrangement to a small degree, but basically the function is the same. A contact closure 36 or 42 closes the motor starter, and a seal in contact 40 maintains the starter coil energized until a contact 44 or 38 (stop contact) breaks the circuit stopping the motor.

Other monitoring equipment has been marketed for controlling motor operation and simultaneously providing status and failure indication. These prior art designs utilize special circuits for controlling the motor with design concepts including complicated and expensive multiplexing of the control signals, computer control, microprocessor control, or including a combination annunciator and stop/start station in one enclosure. Such designs have not gained wide acceptance because the users are slow to relinquish the proven reliability of the conventional control schemes and hardware. Another drawback in these designs is the use of such highly specialized circuits requires a decision making by plant management at the early stages of plant design, and their adaptation of the complicated circuitry to an existing plant often requires major costly changes which many companies are reluctant to make. Another problem associated with the prior art alarm schemes is the lack of any motor status memory being available during a power outage. After the power is restored, the operator must identify which motors were running prior to the outage and which units are blocked out as spares. This can require a substantial amount of time and eliminates the possibility of a quick re-start after a momentary power dip.

A prior art search of the applicants invention in the U.S. Patent Office disclosed patents in the following two very general categories:

A. Multiplex Transmission.

These systems are used to provide multi-information data over the same transmission line and are not considered pertinent to the applicants invention.

B. Two State Indicating Device.

These systems were an improved version of an annunciator and a specialized monitoring and display system capable of visual display and/or alarming the condition of a two state device. Such systems provide the appropriate outputs when a contact or variable is determined to be in an off normal condition. The following brief discussion of each patent uncovered in the prior art search is given for purposes of explanation of that particular prior art:

U.S. Pat. No. 3,714,646

This device is an annunciator system for multiplexing the monitoring at a central location with the operation of the equipment being located at remote points. The system is designed to detect and identify more than one alarm condition in a group of alarm points without having to first correct the initial alarm condition detected. The circuit utilizes diode-transistor logic.

U.S. Pat. No. 3,525,988

This is an improved annunciator with a first out feature utilizing an electro-luminescent window instead of an incandescent lamp for the visual alert. The circuit uses SCR and transistor logic.

U.S. Pat. No. 3,688,294

This circuit is an improved annunciator with a first out feature. This circuit utilizes a transistor for the lamp driver and a SCR memory circuit.

U.S. Pat. No. 3,729,734

This circuit is an improved annunciator with a first out feature and a method of displaying annunciator failure or proper operation. This circuit utilizes relay logic.

U.S. Pat. No. 4,023,077

This circuit is a type of control logic device to produce an output signal when at least two inputs signals are in a chosen condition. The circuit was designed to prevent an operator from opening or closing a lathe chuck when the lathe speed is above a chosen speed. This is a type of speed interlock device.

U.S. Pat. No. 3,813,655

A central station monitors the condition of a group of remote sensors each of which is connected in a reporter unit which generates a characteristic frequency signal, the modulation condition of which is changed when the sensor goes into the alarm condition. This system is a type of frequency multiplexing.

U.S. Pat. No. 3,805,242

This system relates to the multiplex transmission of data between a centrally or conveniently located computer and at least one process to be controlled having a plurality of sensor signals transmitting end stations and control signal receiving end stations. This circuit is a type of frequency multiplexing.

U.S. Pat. No. 3,939,456

This system was designed to display (steady on light) the status of two state (on-off) devices within a furnace that can cause a furnace to shut down. The status lights are displayed in a physical order that will indicate to a service-man which limit has caused the shut down.

U.S. Pat. No. 3,011,162

A fault indicating system is shown which is capable of responding when one contact opens within a group of serially connected contacts. The system also displays the status and provides an audible alarm.

None of the before mentioned patents provide a means to distinguish between a contact that is in the off normal condition due to an operator-initiated function or some other normal condition. The devices taught in the patents can only distinguish between a normal and an abnormal state. The applicant's invention overcomes these shortcomings by providing a means of determining the following condition of a two-state contact:

1. Normal;
2. Off-normal due to an abnormal condition;
3. Off-normal due to a normal condition.

SUMMARY OF THE INVENTION

In order to overcome the problems inherent in the prior art, the applicant's invention has for its primary objective a device which will provide the following functions by adapting to the circuit and hardware normally used by the particular user or piece of equipment.

1. Alert an operator to an equipment failure;
2. Alert an operator to an electric motor failure;
3. Provide memory of motor- or equipment-run status during a power outage;
4. Alert an operator of a failure to start or to complete a commanded operation during a prescribed time period.

The device consists of a basic circuit to detect a failure with options to adapt to the type of inputs available. All the basic circuit needs is a signal to indicate the equipment has stopped, plus a signal to indicate the operator had initiated a stop. Stopping a piece of equipment or motor usually falls in one of the following categories:

1. Pulse to stop, immediate indication that equipment has stopped;
2. Sustained pulse to stop, immediate indication that equipment has stopped;

3. Pulse to stop, delayed indication that equipment has stopped;
4. Sustained pulse to stop, delayed indication that equipment has stopped.

Categories 3 and 4 are typical where a piece of equipment has a coast down time before the stop indication appears. This would be typical of a zero speed switch on a conveyor or a pressure switch on a pump.

Categories 1 and 3 are typical where pushbutton or momentary contact switches are used to stop a piece of equipment.

Categories 2 and 4 are typical where a maintained contact switch is used to stop the equipment.

Category 1 is typical of a motor starter circuit where a set of auxiliary contacts indicate the motor has stopped, which is the most common application.

The basic circuit will handle Categories 1, 2, and 4, but Category 3 is a special case, and the applicant's optional pulse stretcher circuit to be described more fully hereinafter has been adapted to allow it's usage with the basic circuit.

The basic equipment failure module of the subject invention is shown in FIG. 7 by the numeral 24 and is designed to receive two inputs and to transmit three outputs. The first Input 26 receives the run or stop status of the equipment. The second Input 28 receives an input that indicates the equipment has been given a command for a normal stop. The first Output 30 can transmit a pulsating output alternating between a high and low state, while the second Output 32 gives a time delayed steady output signal. The third Output 34 gives a steady output which is a repeat or complement of the first Input 26. All output signals can be a set of normally open contacts, normally closed contacts, high voltage state or low voltage state. The first Output 30 of the applicant's invention indicates visually by flashing a light on the control panel that the equipment has abnormally stopped. The second Output 32 initiates an audible alert, computer input, or a corrective action. The third Output 34 increases the indicating status of the run condition without adding additional inputs, which are generally fed from remote mounted devices. This third Output 34 can be used to feed status to run lights, computer, panel graphic, or other apparatus, and allows the usage of the device in the circuit shown in FIG. 4 without altering the control circuit.

Reference should now be made to FIG. 8 of the drawings:

| | | | Output #1 | | Output #2 | | Output #3 | |
|---|---|---|---|---|---|---|---|---|
| Condition | Input #1 (26) | Input #2 (28) | (30) | Complement | (32) | Complement | (34) | Complement |
| 1 | Run | None | Off | On Steady | Off | On | Off | On |
| 2 | Stop | None | Flash | Flash | On | Off | On | Off |
| 3 | Stop | Stop Pushbutton Depressed | Off | On Steady | Off | On | On | Off |

In Condition 1 the motor is running and is in the normal state. In Condition 2 the motor has stopped without receiving a prior pulse at Input 2 which is computed as a failure and sets the appropriate outputs. The device will remain in this state until the motor is restarted or a momentary pulse at Input 2 resets it. In Condition 3 a momentary pulse was received concurrently with the stop signal. This condition is interpreted as a normal shutdown, and the alarm is not given.

The circuitry alerts the operator to an abnormal shutdown of equipment and ignores a normal shutdown.

The most common usage of the device 24 will be to indicate a motor failure where a set of auxiliary contacts in the motor starter or voltage presence across the run light will indicate the run status, and the stop pushbutton will indicate to the circuitry that a normal shutdown was initiated. Below is a list of other primary elements that can indicate the run status or failure status:

A. Zero speed switch;
B. Current switch indicating loss of current to equipment;
C. Voltage switch indicating loss of voltage to equipment;
D. Pressure switch;
E. Torque switch;
F. Flow switch.

This new and novel device 24 allows the customer to use his standard control scheme and standard switches, pushbuttons, and indicating lights. Pushbuttons, lights, and switches such as General Electric, Westinghouse, Square D, Allen Bradley, Cutler Hammer, Micro Switch, Clark, and other similar hardware used in motor control circuits are compatible with the equipment failure module of the applicant's invention.

The circuits of the subject invention consist of a flip-flop, AND GATE, driver, time delay, and flasher. All circuits in the preferred embodiment are solid state with relay outputs available for interfacing with other devices or circuitry. Logic chips that are used are CMOS and the functional chips are linears with all chips being powered from 12 VDC. The alert output is time delayed to prevent false triggering and the inputs are filtered to reject noise and transients. The input interrogation voltage is current limited preventing a circuit burnout should the wiring inadvertently short to ground.

In the use of the subject invention, photo isolation can be provided on both inputs for the following reasons:

A. Higher contact interrogation voltages can be used. Standard available is 12 VDC without photo isolation.
B. The photo isolation allows interrogation of contacts with AC or DC ranging from 24 volts to 130 volts.
C. The photo isolation allows interrogation of a contact already in use without loading either circuit.
D. High input/output isolation is provided.
E. The photo isolation allows interrogation of the run status light for the run/stop status.

Accordingly, it is an object and advantage of the applicant's invention to provide a new and novel device that monitors the operation/failure status of control circuits, equipment and electric motors with the monitoring being accomplished without altering the existing circuitry or hardware used for control. The subject invention provides outputs for status of operation, initiates an audible alert and/or corrective action, and visual alert for a typical stop/start operation or a command control circuit.

Another object and advantage of the invention is to provide a device that monitors equipment or motor systems for failure with the device providing a stop/run status signal and initiating an alert or corrective action when there is a failure by distinguishing between run, stop, and failure of the equipment.

Yet another object and advantage of the invention is to provide an alarm module that provides at least three outputs wherein Output 1 is a flashing output to indicate the visual alert when a failure is computed, Output 2 is a time delayed steady output to activate an audible alert and/or initiate a corrective action, and Output 3 is a steady output to indicate operation or stop/run status.

Still yet another object and advantage of the subject invention is to retain equipment or motor run/stop memory during a power outage when powered from emergency or battery power and while the motor was running with the power outage being computed as a failure and so indicated when the power is restored.

Yet another object and advantage of the invention is to provide alarm status of a device, motor, or piece of equipment that failed to start or complete a commanded operation during a prescribed period of time.

A further object and advantage of the invention is to provide a new and novel circuit which requires only two inputs with the first input providing the run/stop status, and the other input providing a signal when the operator or some other normal function initiates a shutdown. The run/stop status can be supplied from an existing zero speed switch, current switch, torque switch, voltage switch, pressure switch, auxiliary contact from the motor starter, or voltage presence across the run light. When used as a command failure alarm, an input is tied to the command signal and the other input must receive an input that is representative of the completed command, such as a position switch, etc.

Another object and advantage of the invention is to provide a device that can monitor motor status by tying into the control circuits at several points to obtain the necessary inputs. The monitoring does not require an alteration of the control circuit or hardware to add the alarm module resulting in a control system reliability that is not affected. This advantage allows the process plant to use their standard control scheme and hardware; and since the device does not require additional hardware, panel space, or control circuit modification, it can readily be added to an existing plant.

Still yet another object and advantage of the invention is to provide a device which provides a visual alert by flashing the run status light at the control station with the visual alert directing the operator to the physical location of the panel where the problem exists. This advantage will enable an operator to make an immediate plant re-start after a power outage; and after the power is restored, all the motors that were running prior to the power outage will have a flashing light. This will allow the operator to quickly go down the control panel pushing the start pushbutton at each flashing light. When the motor re-starts, the flashing light (only for that motor) extinguishes, and the run light is illuminated. This advantage makes it possible to provide the visual alert without increasing panel size.

A further object and advantage of the subject invention is to provide an output to trigger a common audible alert which directs the operator's attention to the control panel with the audible being a common horn circuit or utilizing an existing annunciator input for a group of alarm modules.

These and other objects and advantages will become apparent from a review of the drawings and from a study of the description of the preferred embodiment which is given by way of illustration only.

DESCRIPTION OF THE PREFERRED EMBODIMENT

Figure 1:
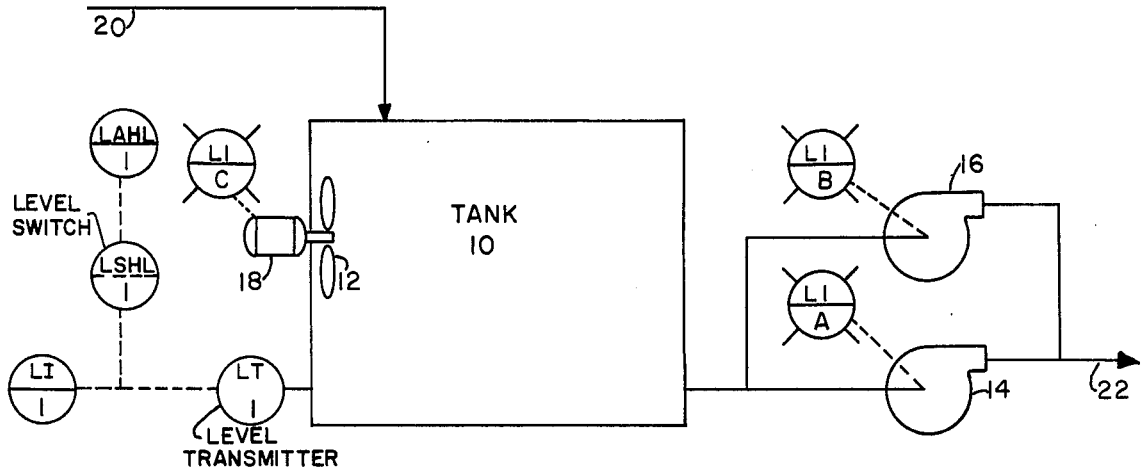
FIGURE 1 PRIOR ART
FIG. 1 illustrates a typical process system with run lights on motor circuits.
Figure 2:
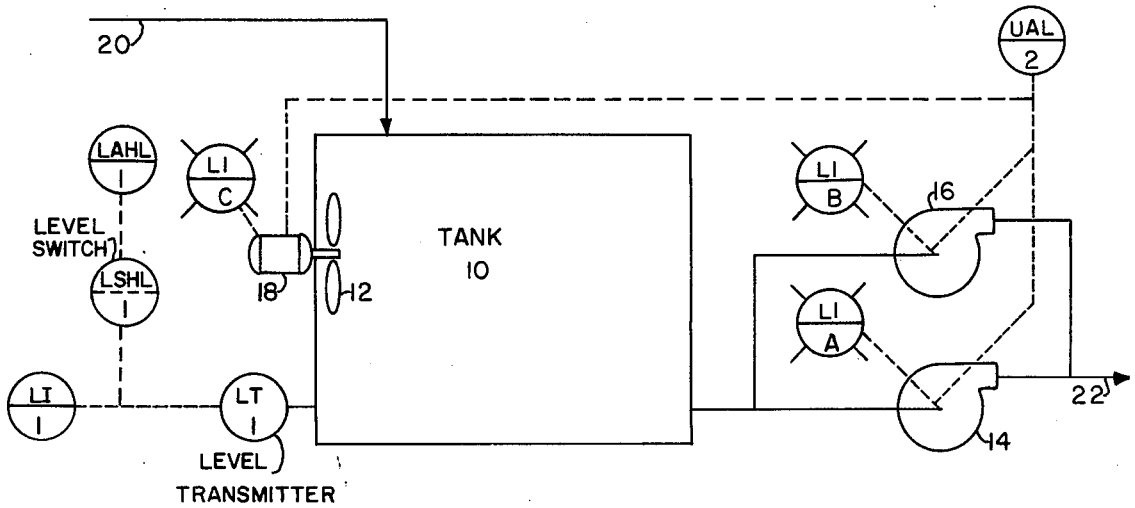
FIGURE 2 PRIOR ART
FIG. 2 illustrates the same process system as FIG. 1, but with motors connected to a common motor failure alarm.
Figure 3:
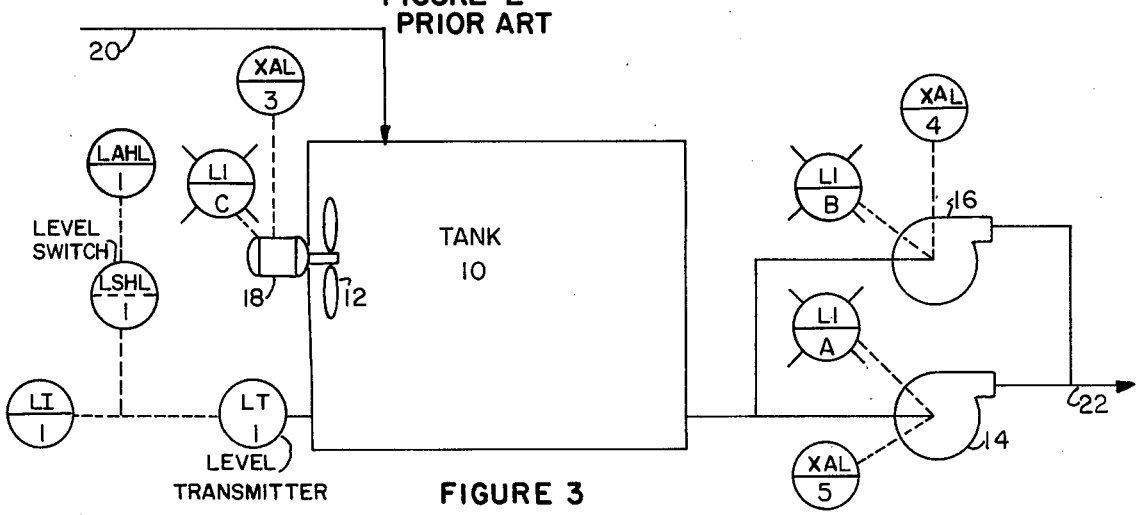
FIGURE 3 PRIOR ART
FIG. 3 illustrates the same process system as FIG. 1, but with motors connected to individual annunciator points.
Figure 4:
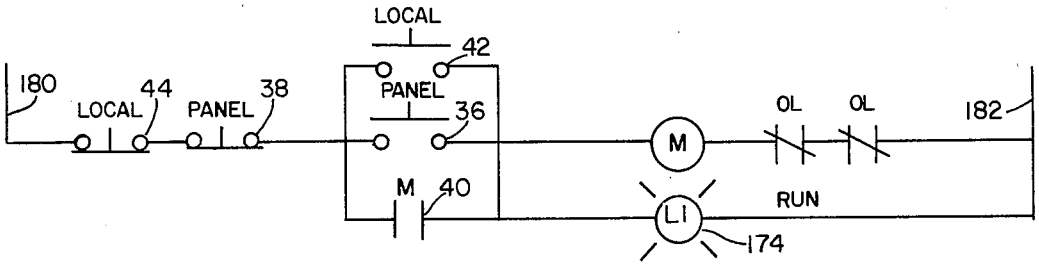
FIG. 4 illustrates typical motor control circuit utilizing one run light.

The basic circuit consists of a memory (50), logic (56), driver (70), flasher (60), and time delay circuit (62); and the circuit functions can be described in modular form as follows by referring to FIG. 9 and allowing a "1" to indicate the high voltage state and a "0" to indicate the low voltage state.

Input 1 (26)—provides the run status.

Input 1' (46)—same as Input 1, but it is optically isolated.

Input 2 (28)—provides the stop information.

Input 2' (48)—same as Input 2, but it is optically isolated.

Memory Circuit (50)

This circuit remembers the last signal that was present on the input terminals, whether the equipment was running or whether an operator initiated a stop. A momentary or sustained "0" at Input 1 (26) or a "1" at Input 1' (46) gives a maintained "1" at the Output 52 of the memory circuit 50. A momentary or sustained "0" at Input 2 (28) or a "1" at Input 2' (48) gives a maintained "0" at the Output 52. A "0" at the Input Terminal 54 of the memory circuit 50 corresponds to a closed contact or 110 VAC when the optical isolator is used. This is a basic RS flip flop circuit constructed by using two NAND GATES (118 and 120) to form the latching circuit.

Logic Circuit (56)

This circuit compares Input 1 (26), which indicates the equipment has stopped, with the Output 52 from the memory circuit 50 which represents why the stop occurred. The Output 58 from the logic circuit 56 triggers the alarm circuits when a failure is computed. The alarm circuits consist of the flasher 60 and time delay circuit 62.

The logic circuit 56 is an AND GATE made by connecting two NAND GATES (122 and 124) in series. A "1" at Input 1 (26) and a "1" at the Input 52 to the logic circuit (which implies the equipment was running and *did not* receive an operator initiated stop signal) will give a "1" at the Output 58 of the logic circuit 56 initiating the alarm circuit. The alarm circuit may be acknowledged by receiving a "0" at the Input 54 to the memory circuit 50 (operator pushes the stop button or common acknowledge pushbutton). The circuit remains in the acknowledged state until a "0" at Input 1 (26) or a "1" at Input 1' (46), indicating that the equipment is running again, thus returning the circuit to it's on-guard state.

Flasher (60)

This module is for giving an alternating on/off output to be used for visual indication of an alarm state. The module will continue to cycle as long as the "1" is present at the logic circuit output 58. The flasher 60 is a LM 555 integrated circuit connected in the astable multivibrator configuration. The device also allows the conversion of an integrated circuit output to a relay output. The relay may be of the mechanical or solid state type.

Time Delay (62)

This unit gives the output for usage to an audible alarm, or to initiate some corrective action when the equipment has failed. The unit allows a conversion from solid state output to a relay output for isolation and allowing higher voltage and current sources to be used. It also provides a time delay to prevent a false indication of a failure due to contact bounce or some other transient condition. A maintained "1" must be present at the output 58 of the logic circuit 56 for a preset period before the output 2 (32) will change states. This unit may also allow a piece of equipment to be failed for a period (times can range from less than a second up to minutes) of time before initiating a corrective action.

Optional Isolator (64)

This provides input isolation by using an optical switch called a photomode. This allows a switch or set of contacts already in use to supply the Input 54 of the memory circuit 50 with a stop status without loading either circuit. Since the existing switch will already have a 110 VAC present, an open contact will trigger Input 54.

Optional Isolator (66)

This provides input isolation by using an optical switch called a photomode. This allows the run status to be obtained from a set of contacts already in use or from the run status lights without loading either circuit.

Optional Pulse Stretcher (68)

The optional pulse stretcher 68 must be used when the equipment has a coast down time and uses a momentary contact to stop the equipment. The memory circuit 50 remembers the last signal present and in this case the stop signal was momentary, and some time later an indication is received that the equipment has stopped giving an alarm although the shutdown was operator initiated.

A memory pulse indicating an operator stop will trigger the optional pulse stretcher 68 and hold the stop signal present to the memory input 90 for a preset time. This preset time must be greater than the coast down time of the equipment. When the signal is received that the equipment has stopped, it will be ignored and the alarm is not triggered. This circuit is a LM 322 precision timer integrated circuit connected in the astable mode (one shot).

Driver (70)

The driver 70 supplies Output 3 (34) which is a repeat or complement of Input 1 (26). The driver 70 converts the low voltage logic signal of Input 1 (26) to a relay output. This circuit is a LM 555 integrated circuit connected as a logic switch.

Parallel Output AC

In several applications it requires the combined Output 1 (30) and 3 (34) to operate a light. This can be accomplished by connecting the N/O contacts of Outputs 1 (30) and 3 (34) in parallel. This same function may be accomplished by connecting the flasher Output 1 (30) to the trigger input of the driver 70, illustrated by connection 92 of FIG. 10. This will improve reliability and lower costs over just paralleling the two contacts.

Power Supply

The circuit is designed to operate on 12 VDC. The source may be from an external power supply which can supply many circuits at the same time, or a low current power supply provided in each equipment-failure module. This will allow an individual module to be powered from a 110 VAC power source. The power supply will be the standard type utilizing a transformer, bridge rectifier, and a 12 V integrated circuit voltage regulator with filtering capacitors.

The solid state alarm module will be primarily for mounting in a control room, computer room, or relay room. The solid state version permits a large number of units to be mounted in a small area, and is suitable for high density mounting. The interconnections for the unit can for the most part be made at the control station terminals located in the control panel. The solid state version will be very versatile and can be manufactured at a lower cost.

The solid state module will be packaged in two versions. One version will utilize a plug-in type printed circuit board which will plug into a high density card rack. Connection will be via terminals located on the back of the card rack. The printed circuit cards will plug into the card rack and can be removed without removing any connections. The second version will also be on a printed circuit card which will be mounted inside a small general purpose (NEMA I) enclosure. The enclosure will be for surface mounting with terminals located on the front of the enclosure.

Figure 10:
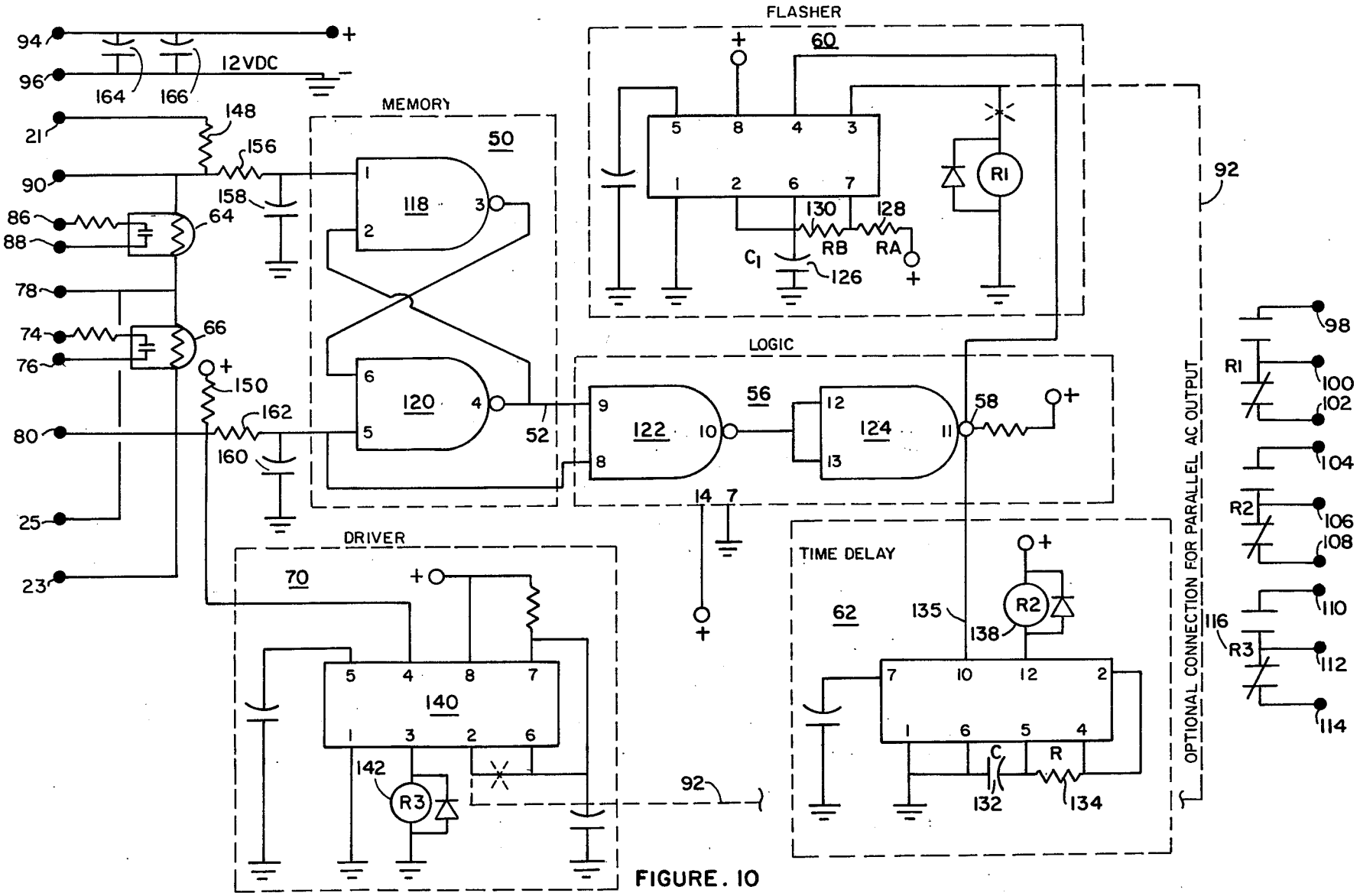
FIG. 10 illustrates the complete wiring schematic of the alarm module.

Referring now to FIG. 10 of the drawing there is shown the complete wiring schematic of the basic alarm module 24. The constructed circuit was made using both linear and CMOS logic. CMOS logic was selected because of its operation at high voltage levels which would make it less susceptible to noise.

Figure 9:
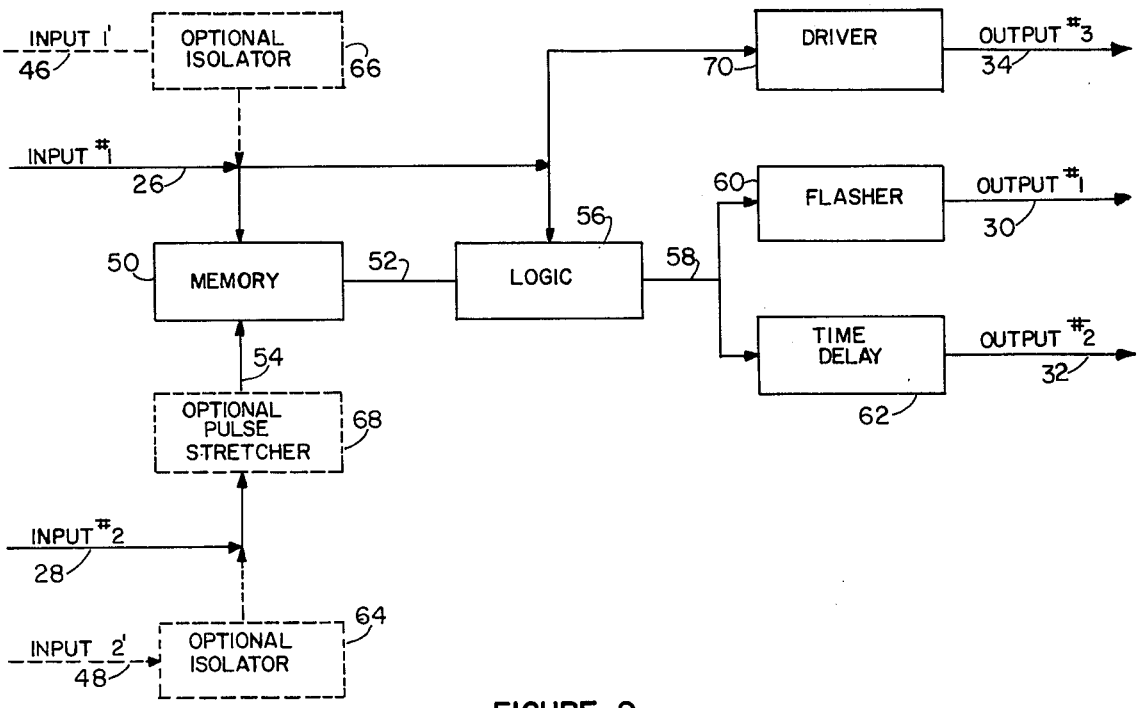
FIG. 9 illustrates in a block-functional diagram the major functional sections of the alarm module.

The inputs and outputs as shown on FIG. 9 are connected to the circuit as follows: (Refer to FIGS. 10 and 12)

| Input | Connections |
|---|---|
| 1' (46) | 74 & 76 |
| 1 (26) | 78 & 80 |
| Optional Pulse Stretcher (68) | 82 & 84 |
| 2' (48) | 86 & 88 |
| 2 (28) | 90 & 78 |
| Power | 94 & 96 |

| Output | Connections | |
|---|---|---|
| 1 (30) | 98 & 100 | |
| 1 Complement | 100 & 102 | |
| 2 (32) | 104 & 106 | |
| 2 Complement | 106 & 108 | |
| 3 (34) | 110 & 112 | (See Note Below) |
| 3 Complement | 112 & 114 | (See Note Below) |
| Parallel AC | 110 & 112 | (See Note Below) |
| Parallel AC (Complement) | 112 & 114 | (See Note Below) |

(Note)
The output from relay R3 (116) must be Output 3 (34) or Parallel AC depending on the connection as shown by Numeral 92 in FIG. 10.

Devices 118 and 120 compose the memory circuit 50. Two NAND GATES connected in this configuration make up a flip-flop latch circuit (50). Devices 122 and 124 compose the logic circuit 56. The NAND GATES connected in this configuration make up the AND GATE. The same circuit could have been made by using two integrated circuits: a flip-flop and an AND GATE. It was decided in the preferred embodiment to make the circuits from CMOS NAND logic for it allows both functions to be put on one integrated circuit chip. Devices 118, 120, 122, and 124 are all on one chip. The chip is a RS 4011N dual input quad NAND GATE.

The flasher circuit 60 gives Output 1 (30). The flasher circuit 60 is a LM 555 timer connected in the astable mode which will free-run as a multivibrator when its input is at a high state. The capacitor 126 charges through resistors 128 and 130 (Ra+Rb) and discharges through Rb. Thus, the duty cycle may be precisely set by the ratio of these two resistors. In this mode the capacitor charges between 4 and 8 volts DC. The charge time for a high output is set by the resistor capacitor network 128, 130, and 126, and the frequency of oscillation is $$f = \frac{1.44}{(Ra + 2Rb)} C_1$$

This allows the flash rate to be set as desired.

The time delay unit 62 gives Output 2 (32). This circuit is a LM 322 precision timer connected in the time out on power up mode. This device operates the same as a time delay relay and prevents an output until the input has been in the high state for RC seconds as set by the resistor capacitor networks 132 and 134. By adjusting the values of R and C, a time delay can be set as desired.

Figure 13:
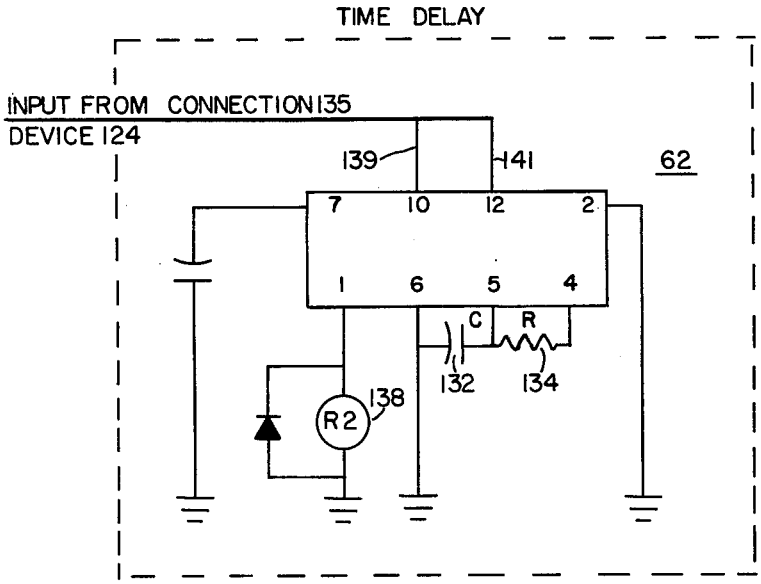
FIG. 13 illustrates an alternate method of connecting up the timer circuit to allow the relay on Ouput 2 to be energized during normal operation.

The timer is connected in a time out on power up (relay energized RC seconds after power to Pin 10 at connection 135 in FIG. 10). In a unit failure or circuit power failure, the relay would remain in its normal state. In some applications, it would be safer to have relay R2 (138) energized when in the normal state so that a failure could fail it to an alarm position. In this case, the timer can be connected in the time out on power down (relay energized RC seconds after power is removed from Pin 10 at connection 139 and Pin 12 at connection 141 as shown in FIG. 13). This connection for the timer is illustrated in FIG. 13.

Item 140 is a LM 555 connected as an On/Off Switch. This allows relay R3 (142) to duplicate Input 1 (26).

Items 64 and 66 are photomodes. A 110 VAC signal on connections 86 and 88 will pull Input 2 (28) to its low state, and 110 VAC on connections 74 and 76 will pull Input 1 (26) to its low state. This allows interrogation of a set of 110 VAC contacts which are already in use. As shown, the circuit is in a quiescent state. Both inputs are held in a high state by their pull up resistors 148 and 150. Inputs 1 (26) and 2 (28) are set to look at a contact closure to set the state. A contact closure at Input 2 (28) sets Device 120 output to its low state. A contact closure at Input 1 (26) sets Device 120 output to a high state. These states are remembered although the contact closure may be only momentary since the circuit will latch in the last state. A high state on both input terminals of Device 122 will set Device 124 output to its high state. This high state will operate the flasher 60 and time delay 62 giving Outputs 1 (30) and 2 (32).

Figure 12:
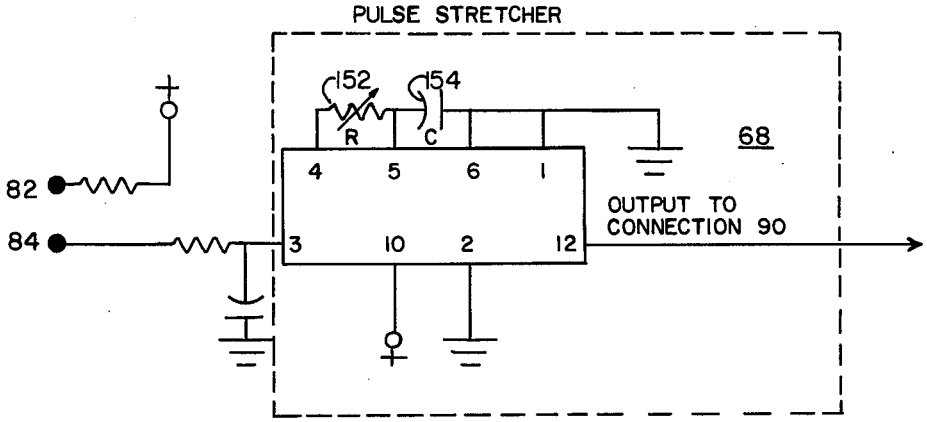
FIG. 12 illustrates the optional pulse stretcher circuit to be used in front of Input 2 to allow for equipment that has a coast down time.

The optional pulse stretcher 68 is shown in FIG. 12 and is a LM 322 precision timer connected in the astable mode. A momentary contact closure across Connections 82 and 84 will trigger the device for RC seconds as set by the variable resistor 152 and the capacitor 154.

The capacitor 158 and the resistor 156 forming an RC network and the capacitor 160 and resistor 162, forming an RC network, provide input filtering for Inputs 1 (26) and 2 (28). Capacitors 164 and 166 provide filtering for the DC power source.

The application of the device is so diversified it would be impossible to illustrate every way of connecting it to a circuit. The device is designed to adapt to the user's circuit. Since the most common usage would be to monitor motor operation for a failure, several typical connections are illustrated in FIGS. 14, 15, and 16.

Figure 15:
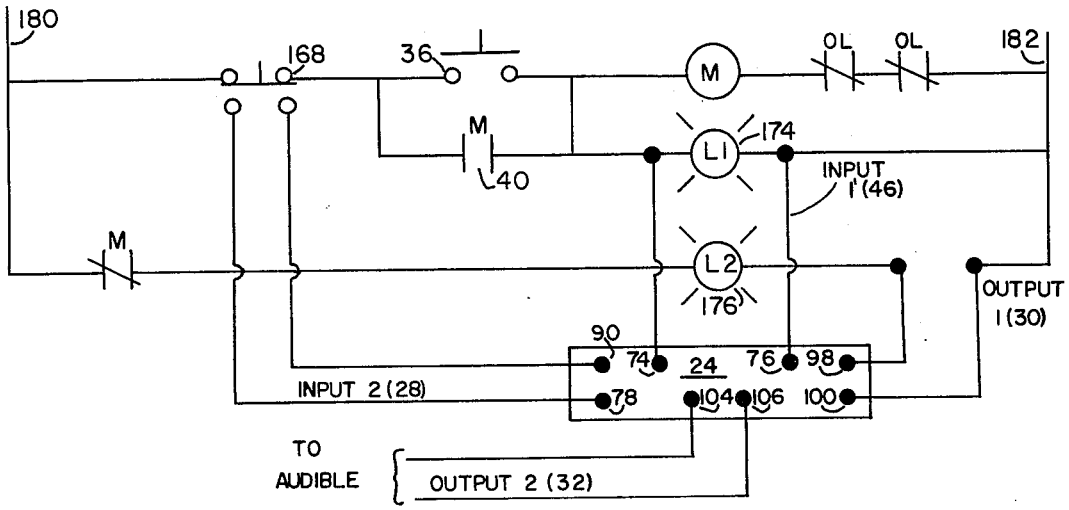
FIG. 15 illustrates a typical application connecting the alarm module to the circuit shown in FIG. 5. This circuit utilizes power from the motor control circuit to supply L2.
Figure 16:
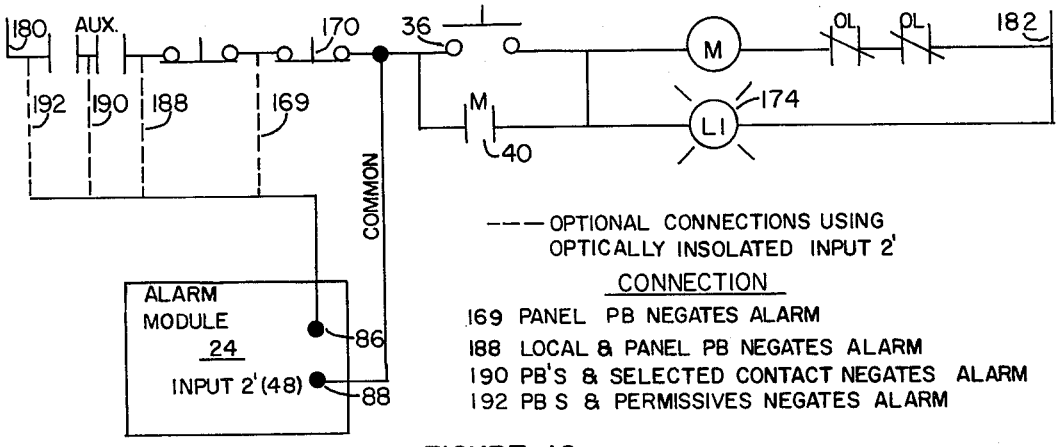
FIG. 16 illustrates alternate methods of connecting Input 2 to a typical motor control circuit.

In a motor control circuit, the device can use the N/O set of contacts on the stop pushbutton 168 (FIGS. 14 and 15), or interrogate the presence at Connection 169 of open contacts 170 in the 110 VAC control circuit as illustrated in FIG. 16 for Input 2 (28).

Figure 14:
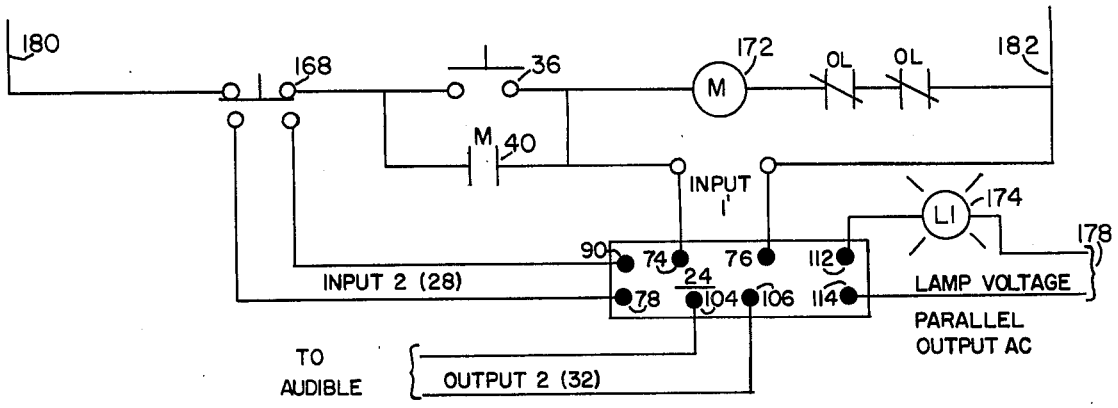
FIG. 14 illustrates a typical application connecting the alarm module to the circuit shown in FIG. 4. This circuit utilizes an alternate source of power to supply L1.

The run signal to Input 1 (26) may be obtained from a separate set of auxilliary contacts (not shown in the drawings) in the motor starter or from the presence of 110 VAC across the starter coil M (172) as shown in FIG. 14. The latter requires the optically isolated input.

FIGS. 14 and 15 illustrate two methods of utilizing run light L1 (174) and run light L2 (176) for the visual alert. FIG. 14 operates L1 (174) from a separate voltage source 178, while FIG. 15 operates L2 (176) from the MCC control voltage across hot connection 180 and neutral connection 182. FIG. 15 is accomplished by connecting the contact for Output 1 (30) in series with L2 (176).

The sequence is as follows:

| | FIG. 14 | FIG. 15 |
|---|---|---|
| Motor running: | L1 on | L1 on |
| Motor stopped: | L1 off | L2 on, L1 off |
| Motor failed: | L1 flashing (See Note Below) | L2 flashing, L1 off |

Figure 11:
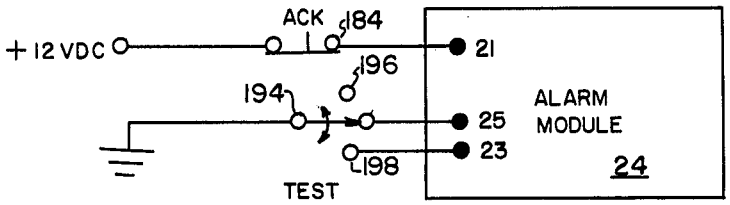
FIG. 11 illustrates connection for common acknowledge and test circuit.

(Note)
L1 or L2 will remain flashing until the motor is re-started, stop pushbutton 168 depressed, or the common acknowledge pushbutton 184 (FIG. 11) depressed.

Figure 5:
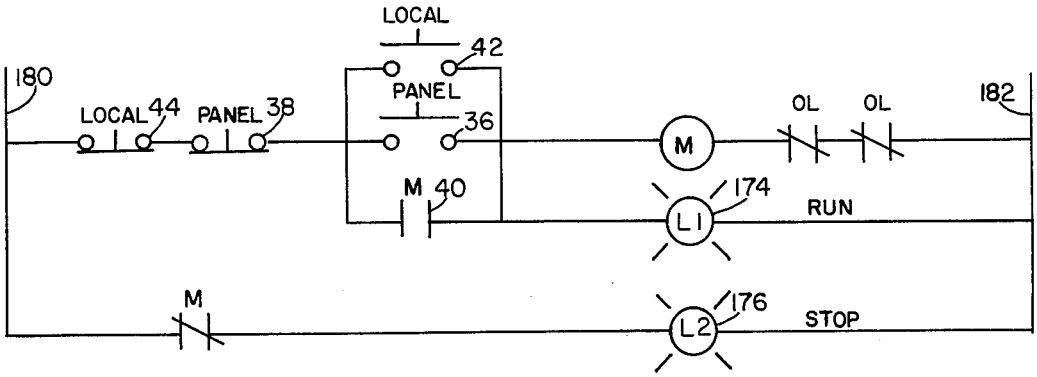
FIG. 5 illustrates typical motor control circuit utilizing two status lights; one for run, and one for stop.
Figure 6:
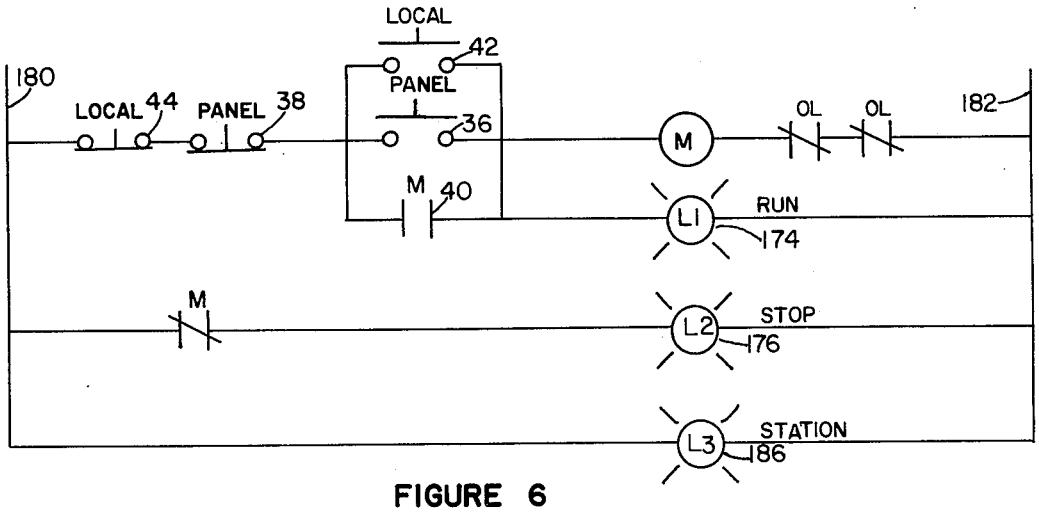
FIGURE 6 PRIOR ART
FIG. 6 illustrates a typical motor control circuit with stop/run and station lights.
Figure 7:
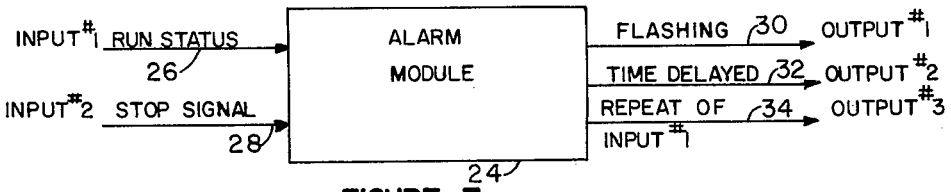
FIG. 7 illustrates inputs and outputs available from the alarm module.
Figure 8:
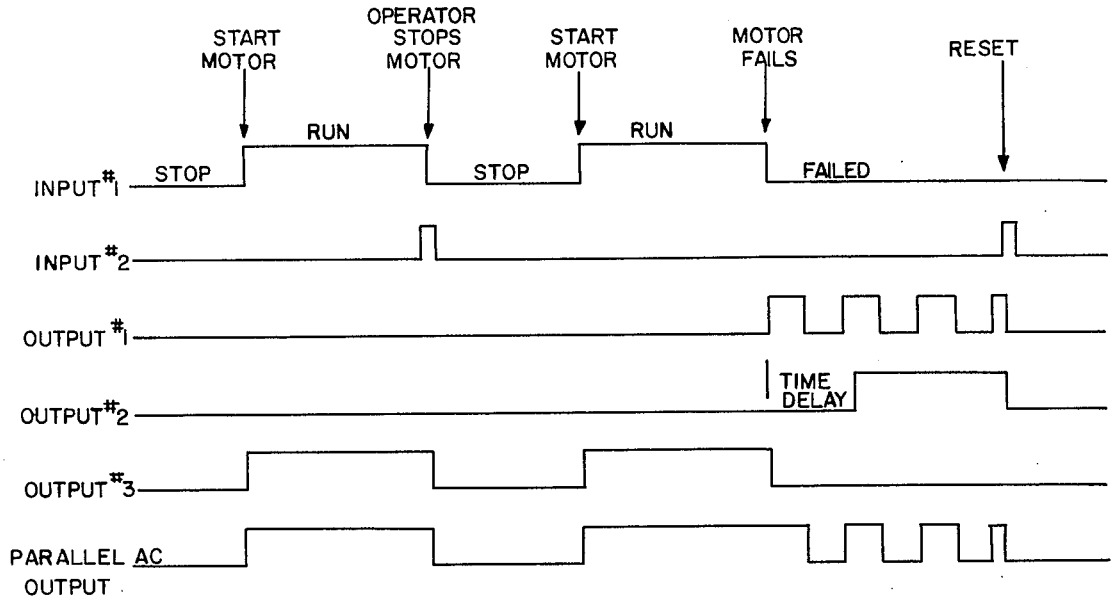
FIG. 8 illustrates in the time-amplitude domain the relationship of the input signals to the output signals keyed to process events.

In FIG. 5, L1 (174) or L2 (176) may be used for the visual alert, and in FIG. 6, L1 (174), L2 (176), or L3 (186) may be used for the visual alert. When using L1 (174), parallel output AC must be used. When using L2 (176) or L3 (186), Output 1 (26) must be used. The lamps L1, L2, and L3 may be powered from the MCC control voltage or an external source.

FIG. 16 illustrates optional connections for Input 2' (48). The circuit can be made to compute any of the following as a normal shutdown by the way Input 2' (48) is connected to the circuit:

A, Panel stop pushbutton;
B. Local stop pushbutton; panel stop pushbutton;
C. Selected permissive contacts and stop pushbuttons;
D. All permissive contacts and stop pushbuttons;
E. Any combination of the above.

FIG. 16 illustrates the connection using the optional Input 2' (48) (photomode input). The circuit detects the presence of a 110 VAC (indicating an open contact) as a normal shutdown. When using optional connections 188, 190, or 192, an external acknowledge pushbutton 184 (FIG. 11) is required. One pushbutton can be used to acknowledge as many alarm modules as desired.

TEST AND COMMON ACKNOWLEDGE CIRCUIT

The common acknowledge circuit consists of a normally closed pushbutton 184 remotely located to rest a number of basic alarm modules 24 simultaneously. One pushbutton 184 can reset as many modules 24 as required. When the acknowledge pushbutton 184 is depressed, it breaks the power to pull up Resistor 148, setting Input 2 (28) to the low state "0". A low state "0" at Input 2 (28) negates the alarm condition.

The test circuit consists of a DOUBLE POLE, 3-position switch 194 with spring return to the center position. The functional test circuit must be performed in two steps. One step tests the circuits that are in a run state, and the other step tests the circuits that are in a stopped state. The two steps are as follows:

1. Circuits in a run state: Rotate test switch 194 to Position 196. Hold switch in Position 196 as long as test is required. Releasing switch 194 will cause circuit to return to the normal state. This simulates a trip condition by breaking the ground from Input 1 (26) causing it to go to the high state.
2. Circuits in a stopped or acknowledged state: Rotate test switch 194 to Position 198 and release. Depress acknowledge pushbutton 184 to reinstate circuits to the normal state. Rotating the switch 194 to Position 198 grounds Input 1 (26), pulling Input 1 (26) to the low state "0" simulating a run condition. The run condition sets the circuits in an on-guard condition. Releasing the switch 194 breaks the ground, setting Input 1 (26) to the high state "1" which simulates a trip condition.

The design of the circuit permits the device to be used without the common test and acknowledge switch. The stop pushbutton provides an individual acknowledge function and the circuit may be tested by momentarily stopping the motor from the field pushbutton. When the common test and acknowledge circuit is not utilized connection 21 (FIG. 10) should be connected to +12 VDC supply and connection 78 (FIG. 10) connected to ground. Therefore connections 21, 78, 25 and 23 would not be required.

When using the optical isolator 66 on the Input 1' (46), the device will also alarm on a failure to start when the start pushbutton 36 is depressed even if the motor made no attempt to start. The device detected a command was given to start, but the motor did not respond. When the start pushbutton 36 is depressed, 110 VAC is imposed across Input 1' (46) and immediately disappears due to the start contact 40 failing to seal in. The application of the device can be expanded to include an alarm function and/or initiate a corrective action when a device, equipment, or motor fails to respond to a command. The command failure can be of two types:

A. Momentary command signal given and t seconds later feedback is received that the command is completed.
B. Sustained command signal given and t seconds later feedback is received that the command is completed.

Item A (above) is typical of a motor starter where the command signal is Input 1' (46) and a seal in contact 40 holds the command signal present when the starter coil pulls in and latches.

Item B (above) is typical of an auto motor start sequence or a control valve operated from a switch, sequence timer, or auto control circuit. In this case, the command signal feeds into Input 1' (46) and the completed command feedback feeds into Input 2 (28). For a control valve application the command signal would be power to the valve or actuating device, and the feedback would be a position switch to indicate when the valve has reached the new position. When the command is given, the device goes to its alarm condition, but Output 2 (32) is time delayed to allow time for the valve to reach full travel. The time delay would be set a few seconds longer than the stroking speed of the valve. Therefore, when the valve reaches the new position, a feedback to Input 1' (46) resets the device before the time cycle is completed, aborting the alarm. Should the valve fail to reach the new position prior to the time period, then Output 2 (32) will indicate the failure. In this mode, Output 3 (34) indicates the operation in progress.

The applicant's new and novel alarm module uses the visual alert indication which may be powered from the MCC circuit, emergency power, device power supply, or any other available power source. The device can monitor the following equipment stop/start control circuits:

A. Pulse to stop, immediate indication that equipment has stopped;
B. Sustained pulse to stop, immediate indication that equipment has stopped;
C. Pulse to stop, delayed indication that equipment has stopped;

D. Sustained pulse to stop, delayed indication that equipment has stopped.

Items A, B, and D (above) can be used with the basic circuit, and Item C (above) requires the optional pulse stretcher.

The designer, using the applicant's alarm module, has the capability of selecting which trip contacts he would like for the device to compute as a normal stop. Therefore, all other trip contacts would be representative of a failure.

The device can be mounted in the control room and connected to the motor control circuit at the terminal points located in the control panel. Additional hardware or field wiring are not required. In addition, the device can be mounted in the motor control center and connected to the motor control circuit at terminal points located in the MCC. An entire group of motors can be monitored in the control room by pulling four wires from the MCC to the control room for the entire group. Two wires are required for the reset and two for the audible alarm.

The applicant's device provides individual monitoring of motor status without increasing panel size or installing additional panel hardware, and provides a visual alert in the run status light which directs the operator to the physical location of the controls. The system can acknowledge the visual alert one circuit at a time by depressing the stop pushbutton. The common reset pushbutton resets all circuits at the same time when desired. In addition, restarting of the motor or equipment resets the alarm circuit. The visual and audible alarms are separate; therefore, the audible can be acknowledged without affecting the visual.

From the foregoing it can be seen that all the objects and advantages have been provided by applicant's invention. Nevertheless, it is apparent that many changes can be made in the circuitry and arrangements of parts without departing from the spirit and scope of the invention which has been shown in the preferred embodiment by way of illustration only.

Having described my invention, I claim:

1. A device for monitoring an electrical stoppage or failure in an electrical circuit for a piece of electrical equipment comprising:

(a) an alarm module having at least two inputs and at least three outputs, (1) the first input being used to receive a run or stop status of the piece of electrical equipment being monitored;

(2) the second input being used to receive a signal indicating that the circuit being monitored has been given a normal stop command;

(3) the first output being designed to transmit a pulsating output signal alternating between a high and a low state;

(4) the second output being designed to transmit a time delayed steady output signal; and (5) the third output being designed to transmit a steady output which is a repeat or complement of the first input.

2. The device as defined in claim 1 wherein the run status of the piece of electrical equipment being monitored is obtained by utilizing a photo isolated input as the first input and connecting the photo isolated input across an existing run status light of the equipment being monitored.

3. The device as defined in claim 1 wherein the piece of electrical equipment being monitored is an electrical motor having dry motor starter contacts and the run status of the motor is obtained by connecting the first input to the set of dry motor starter contacts.

4. The device as defined in claim 1 wherein the equipment being monitored is electrically connected to a set of contacts on a panel located stop pushbutton for the equipment, and the stop status of the equipment is obtained by connecting the second input to the contacts.

5. The device as defined in claim 1 wherein the equipment being monitored is electrically connected to a contact of a panel stop pushbutton, and the stop status of the equipment is obtained by utilizing a photo isolated input as the second input and connecting the photo isolated input across the contacts of the panel stop pushbutton.

6. The device as defined in claim 1 wherein the equipment being monitored is electrically connected to a contact of a panel and local stop pushbutton, and the stop status of the equipment is obtained by utilizing a photo isolated input as the second input and connecting the photo isolated input across the contacts of the panel and local stop pushbutton.

7. The device as defined in claim 1 wherein the equipment being monitored is electrically connected to a contact of an equipment stop pushbutton, and the stop status of the equipment is obtained by utilizing a photo isolated input as the second input and connecting the photo isolated input across the contacts of the equipment stop pushbutton.

8. The device as defined in claim 4 further comprising a pulse stretcher being connected between the second input and the monitoring device for use with monitored equipment having a coast down time and a momentary contact to stop the equipment.

9. The device as defined in claim 5 further comprising a pulse stretcher being connected between the second input and the monitoring device for use with monitored equipment having a coast down time and a momentary contact to stop the equipment.

10. The device as defined in claim 6 further comprising a pulse stretcher being connected between the second input and the monitoring device for use with monitored equipment having a coast down time and a momentary contact to stop the equipment.

11. The device as defined in claim 7 further comprising a pulse stretcher being connected between the second input and the monitoring device for use with monitored equipment having a coast down time and a momentary contact to stop the equipment.

12. An electrical motor monitoring device for detecting at least three electrical conditions of the type wherein Condition 1 represents the normal condition of the motor running, Condition 2 represents the motor stopped without receiving a prior pulse, and Condition 3 represents a momentary pulse received concurrently with a stop signal, said device comprising at least two inputs and at least three outputs wherein each output has a primary (P) and a complement (C) output, the complement output being the exact opposite of the primary, said three electrical conditions causing the monitoring device to react according to the following:

| Condition | Input 1 | Input 2 | Output 1(P) | Output 1(C) | Output 2(P) | Output 2(C) | Output 3(P) | Output 3(C) |
|---|---|---|---|---|---|---|---|---|
| 1 | Run | None | Off | On | Off | On | Off | On |

-continued

| Condition | Input 1 | Input 2 | Output 1(P) | Output 1(C) | Output 2(P) | Output 2(C) | Output 3(P) | Output 3(C) |
|---|---|---|---|---|---|---|---|---|
| 2 | Stop | None | Flash | steady Flash | On | Off | On | Off |
| 3 | Stop | Stop Push-button Depressed | Off | On steady | Off | On | On | Off |

13. An alarm module for monitoring and detecting an electrical stoppage or failure in a device, comprising:

(a) a memory circuit having a first and a second input terminals and an output terminal and being designed for receiving one or more input signals and being responsive thereto to remember the last signal present on one of the input terminals, a momentary or sustained low voltage state at the first input terminal serving to provide a high voltage state at the output of the memory circuit while a momentary or sustained low voltage state at the second input terminal serving to provide a low voltage state at the output of the memory circuit;

(b) a logic circuit, connected to the output of the memory circuit and also connected to the first input terminal, for comparing the input from the first input terminal with the output from the memory circuit, said logic circuit also having an output terminal which triggers an alarm circuit when a failure in the device being monitored is computed;

(c) at least two alarm circuits connected in parallel to the output terminal of the logic circuit and triggerable whenever a failure of the monitored device is computed, the alarm circuits comprising:

(1) a flasher circuit for giving an alternating on/off output to be used for visual indication of an alarm state, the flasher continuing to flash as long as a high voltage state is present at the output terminal of the logic circuit;

(2) a time delay circuit having an output and for giving the output for usage to an audible alarm, the output of the time delay also serving to initiate a corrective action when desired whenever the device monitored has failed, a high voltage state at the output of the logic circuit for a preset period being required before the output will change states; and (d) a driver circuit connected to the first input terminal of the memory unit for supplying a steady output which is a repeat of the input supplied to the first input terminal, the driver circuit serving to convert a low voltage logic signal of the input of the first input terminal to a relay output.

14. The alarm module as defined in claim 13 further comprising a pulse stretcher being connected between the second input and the memory circuit for use with monitored equipment having a coast down time and a momentary contact to stop the equipment.

15. The alarm module as defined in claim 13 further comprising a photo isolator being connected between the first input terminal and the memory circuit to allow the run status of the monitored device to be obtained from a set of electrical contacts already in use on the device or from the run status lights on the device without loading either circuit.

16. The alarm module as defined in claim 13 further comprising a photo isolator being connected between the second input terminal and the memory circuit to allow a switch or set of contacts already in use on the device to provide a stop status without loading either circuit.

17. The alarm module as defined in claim 13 wherein the logic circuit comprises in part an AND gate utilizing two NAND gates in a NAND-NOT configuration.

18. The alarm module as defined in claim 13 wherein the memory circuit comprises in part a bistable multivibrator flip flop utilizing two NAND gates in a latching configuration.

19. The alarm module as defined in claim 13 wherein the flasher circuit comprises in part an astable multivibrator.

20. The alarm module as defined in claim 13 wherein the time delay circuit comprises in part a solid state time delay.

21. The alarm module as defined in claim 13 wherein the driver circuit comprises in part a solid state switch.

* * * * *